United States Patent [19]

Barrett et al.

[11] Patent Number: 4,610,736

[45] Date of Patent: Sep. 9, 1986

[54] NICKEL BASE COATING ALLOY

[75] Inventors: Charles A. Barrett, Fairview Park; Carl E. Lowell, Lakewood, both of Ohio

[73] Assignee: The United States of America as represented by the Administrator of the National Aeronautics and Space Administration, Washington, D.C.

[21] Appl. No.: 478,131

[22] Filed: Mar. 23, 1983

[51] Int. Cl.[4] ..... C22C 19/03

[52] U.S. Cl. ..... 148/429; 420/460

[58] Field of Search ..... 420/460; 148/409, 429

[56] References Cited

U.S. PATENT DOCUMENTS

| | | | |
|---|---|---|---|
| 2,910,356 | 10/1959 | Grala et al. | 420/460 |
| 3,260,505 | 7/1966 | Ver Snyder | 253/77 |
| 3,494,709 | 2/1970 | Piearcey | 416/232 |
| 3,564,940 | 2/1971 | Thompson et al. | 75/134 |
| 3,677,835 | 7/1982 | Tien et al. | 148/32.5 |
| 3,869,284 | 3/1975 | Baldwin | 75/134 F |
| 4,340,425 | 7/1982 | Frosch | 420/445 |

OTHER PUBLICATIONS

Gmelin, "Handbuch Der Anorganischen Chemie", 8th Ed, System Nr. 35A, Aluminum (1934), pp. 969, 970, 971, 1004.

*Primary Examiner*—R. Dean

*Attorney, Agent, or Firm*—Gene E. Shook; John R. Manning

[57] ABSTRACT

Zirconium is added to a Ni-30 Al (Beta) intermetallic alloy in the range of 0.05 w/o to 0.25 w/o. This addition is made during melting or by using metal powders. The addition of zirconium improves the cyclic oxidation resistance of the alloy at temperatures above 1100° C.

7 Claims, 1 Drawing Figure

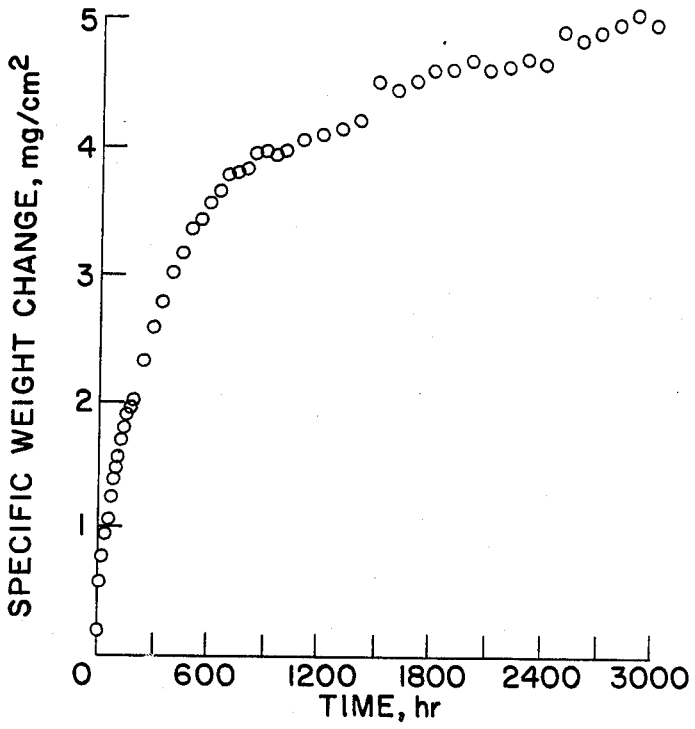
SPECIFIC WEIGHT CHANGE, mg/cm²
5
4
3
2
1
0
600
1200
1800
2400
3000
TIME, hr

NICKEL BASE COATING ALLOY

ORIGIN OF THE INVENTION

The invention described herein was made by employees of the United States Government and may be manufactured and used by or for the Government for governmental purposes without the payment of any royalties thereon or therefor.

TECHNICAL FIELD

This invention is concerned with a coating alloy containing nickel and aluminum. The invention is particularly directed to a beta phase intermetallic alloy having improved oxidation resistance.

It has been found desirable to improve the cyclic oxidation resistance of a Ni-30 Al (beta) alloy at temperatures above 1100° C. Such an alloy has no basic alloy additives because of the difficulties encountered when it is attempted to add small controlled amounts of elements to the beta intermetallic alloy.

Protective coatings of $Al_2O_3$ have been used in the prior art. It has been found in cyclic testing above 1100° C. that such protective coatings would tend to spall or flake off when cooled.

BACKGROUND ART

Thompson et al U.S. Pat. No. 3,564,940 discloses a high strength, eutectic alloy directionally solidified or as high strength whiskers. A nickel-aluminum-chromium-zirconium alloy described in this patent contains many other elements. The nickel content can be as high as 35.2 atomic percent, and the zirconium content can be as low as 0.005 weight percent.

DISCLOSURE OF INVENTION

This invention is directed to an alloy which contains nickel and about 30 weight percent aluminum forming a $\beta$ phase intermetallic alloy to which zirconium is added. The zirconium addition is in the range of 0.05 w/o to 0.25 w/o. This addition improves the cyclic oxidation resistance of the alloy at temperatures above 1100° C.

BRIEF DESCRIPTION OF THE DRAWING

The objects, advantages, and novel features of the invention will be more fully apparent from the following detailed description when read in connection with the accompanying drawing. The graph which forms the drawing shows specific weight change plotted against time for a 3000 hour test having one hour exposure cycles at 1200° C. in static air of 2.32 mm thick test samples of a Ni-30 Al (beta) intermetallic alloy to which zirconium had been added in accordance with the present invention.

BEST MODE FOR CARRYING OUT THE INVENTION

Small amounts of zirconium were alloyed to a nominal nickel-30 aluminum (beta) intermetallic alloy in accordance with the invention. This was accomplished by melting the metallic alloy in a zirconia lined crucible. By joint melting of two separate master heats, the exothermic reaction caused by combining the two heats enables the zirconium to be leached from the zirconia liner without melting at an excessively high temperature. After melting, the intermetallic alloy contained 0.20 w/o zirconium.

The cyclic oxidation resistance of this intermetallic alloy was significantly improved by the zirconium addition. The scaling rate was found to be essentially parabolic for out to 3000 one hour exposure cycles at 120020

C. in static air. A scaling rate parabolic scaling constant of just under 0.01 was derived for the sample shown in the drawing.

Based on the tests shown in the drawing it was found the oxidation resistance of this alloy to be far superior to conventional coating alloys or any other alloy or coating in the iron-, nickel-, or cobalt-base systems. This includes the best FeCrAl heater alloys.

The nickel-30 aluminum (beta) alloy without any zirconium addition was tested in a similar manner. It was evident that the small zirconium addition resulted in an improvement of several orders of magnitude.

DESCRIPTION OF THE ALTERNATE EMBODIMENTS

After the nickel-30 aluminum (beta) intermetallic alloy having the small zirconium addition had proved itself in the cyclic oxidation testing shown in the drawing, the alloy was also produced as metal powder. A 0.17 w/o zirconium addition was made to the powder which was hot extruded to a dense alloy. This same dense alloy was produced from the powder by hot isostatic pressing. The resulting alloy showed the same superior cyclic oxidation resistance as the melted alloy.

While several embodiments of the invention have been disclosed and described, it will be apparent that various modifications may be made to these alloys without departing from the spirit of the invention or the scope of the subjoined claims.

1. An improved oxidation resistant nickel base alloy consisting essentially of
   an intermetallic (beta) alloy containing about 30 weight percent aluminum,
   between about 0.05 weight percent to about 0.25 weight percent zirconium, and
   the remainder being nickel.

2. In a nickel-30 w/o aluminum (beta) intermetallic alloy, the improvement comprising
   the addition of between about 0.05 w/o to about 0.25 w/o zirconium to improve the cyclic oxidation resistance at elevated temperatures.

3. A method of improving the cyclic oxidation resistance of a nickel-30 weight percent aluminum (beta) intermetallic alloy at temperatures above about 1100° C. comprising
   adding small amounts of zirconium between about 0.05 w/o to about 0.25 w/o to the alloy thereby inhibiting spalling at high temperatures.

4. A method of improving the cyclic oxidation resistance of a (beta) intermetallic alloy as claimed in claim 3 wherein the intermetallic alloy is heated to the melting temperature, and
   the zirconium is added to the melted alloy.

5. In a method of improving the cyclic oxidation resistance of a nickel-30 weight percent aluminum (beta) intermetallic alloy at temperatures above about 1100° C., the improvement comprising the steps of
   mixing predetermined amounts of nickel and aluminum powders, and
   adding about 0.17 w/o zirconium powders to said mixture.

6. A method of improving the cyclic oxidation resistance of a (beta) intermetallic alloy as claimed in claim 5 wherein the mixed powders are hot extruded to form a dense alloy.

7. A method of improving the cyclic oxidation resistance of a (beta) intermetallic alloy as claimed in claim 5 wherein the mixed powders are hot isostatically pressed to form a dense alloy.

* * * * *